US007261290B2

(12) United States Patent
Funk et al.

(10) Patent No.: US 7,261,290 B2
(45) Date of Patent: Aug. 28, 2007

(54) SMALL/SPECIAL MEDIA GUIDE-IN TRAY

(75) Inventors: John N. Funk, Lexington, KY (US); Kevin M. Johnson, Georgetown, KY (US); Michael W. Lawrence, Lexington, KY (US); Bryan C. Scharf, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 322 days.

(21) Appl. No.: 10/933,614

(22) Filed: Sep. 3, 2004

(65) Prior Publication Data

US 2006/0049575 A1 Mar. 9, 2006

(51) Int. Cl.
*B65H 1/00* (2006.01)

(52) U.S. Cl. ..... 271/171; 271/3.14; 271/207; 271/223

(58) Field of Classification Search ..... 271/163, 271/171, 145, 8.1, 3.14, 3.01, 207, 223; 347/104
See application file for complete search history.

(56) References Cited

U.S. PATENT DOCUMENTS 3,807,725 A * 4/1974 Bookless ..... 271/171
3,807,726 A * 4/1974 Bookless ..... 271/171
4,418,903 A * 12/1983 Landa ..... 271/10.04
4,791,457 A 12/1988 Shida
4,796,055 A 1/1989 Takano et al.
4,896,871 A 1/1990 Idenawa
5,000,596 A 3/1991 Naruki
5,120,040 A 6/1992 Worley
5,127,646 A * 7/1992 Matsuda et al. ..... 271/171
5,145,160 A 9/1992 Nagashima et al.
5,152,622 A * 10/1992 Rasmussen et al. ..... 400/579
5,222,722 A * 6/1993 Kamano ..... 271/9.09
5,695,182 A 12/1997 Sekine
5,927,702 A 7/1999 Ishii et al.
5,946,527 A 8/1999 Salgado et al.
6,152,440 A 11/2000 Yip et al.
6,325,503 B1 * 12/2001 McCue et al. ..... 347/101
6,406,201 B1 6/2002 Beretta et al.
6,728,509 B2 4/2004 Cornelius
6,926,267 B2 * 8/2005 Kobayashi ..... 271/3.14
2002/0190460 A1 * 12/2002 Gaarder et al. ..... 271/117
2002/0194748 A1 * 12/2002 Jackson et al. ..... 36/51
2003/0047860 A1 * 3/2003 Takamatsu ..... 271/3.14
2003/0141655 A1 * 7/2003 Bryer ..... 271/264

FOREIGN PATENT DOCUMENTS

JP 04197967 A * 7/1992 ..... 271/171

* cited by examiner

*Primary Examiner*—Patrick Mackey
*Assistant Examiner*—Kalyan Kumar
(74) *Attorney, Agent, or Firm*—James E. Cole, Esq.

(57) ABSTRACT

A small or special media guide-in tray including a media tray, an aperture disposed in the media tray, first and second opposed guide arms extending through the aperture and biased to a first position. The first and second opposed guide arms are pivotally mounted and are synchronously movable when small media is inserted. The opposed guide arms and biasing are used to automatically center the small media as it is inserted between the guide arms. The guide-in tray may be utilized with media handling devices having an L-path media feed wherein the guide-in media tray is incorporated in an input tray or in a C-path media feed wherein the guide-in media tray is incorporated in an exit tray.

21 Claims, 9 Drawing Sheets

SMALL/SPECIAL MEDIA GUIDE-IN TRAY

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTINGS, ETC.

None.

BACKGROUND

1. Field of the Invention

The present invention provides a media feed mechanism. More specifically, the present invention provides a small/specialty media guide-in tray for a peripheral device which is auto-centering and may be utilized without removing media from an input tray.

2. Description of the Related Art

L-path media feed systems have been used for media handling devices such as stand-alone printers and multi-functions devices. In L-path media feed systems, the input media is positioned at the rear of the device in a nearly vertical orientation. The L-path media feed system further comprises a substantially horizontal output tray and a printing zone defined between the input tray and the output tray. The media is moved through a feed path from the near vertical orientation to a substantially horizontal orientation, thus when viewed from a side, the media moves through a substantially L-shaped path.

Alternatively, a C-path media feed has also been used in printers and multifunction devices. In general, a C-path paper feed utilizes a substantially horizontally disposed input tray adjacent a substantially horizontally disposed output tray. Typically, the input tray is positioned beneath the output tray and, as such, is also known as a bottom loading device. The feed path is generally curved from the input tray to the print zone and further to the output tray in order to move the media through a print zone. From the side this resembles a substantially C-shaped path. Due to the construction of the C-path media feed, the height of the peripheral or printer is generally decreased because the large upwardly extending media tray used with L-path media feeds is removed. Further, the media is generally hidden from view within the interior of the printer or multi-function device, which is aesthetically pleasing. Finally, with the input tray oriented horizontally, the C-path feed device does not have multi-sheet feed problems due to gravity which are typically associated with L-path media feeds.

In either feed system, a new need has arisen. New peripheral devices are utilizing edge-to-edge printing functions for various media sizes. To this end, the new peripheral devices may also utilize center-oriented media feed systems so that media is properly positioned for edge-to-edge printing. However, one difficulty with the center-oriented feed systems is with alignment of the media. More specifically, prior art devices typically align one edge of the media on a wall of the media tray to ensure alignment and inhibit skewing. While this prior art method aids alignment of the media, it is problematic for true edge-to-edge printing.

Further, with the use of small media such as envelopes, photo cards, index cards and the like for edge-to-edge printing, it is desirous that a center fed media feed system be utilized. It is even more convenient if a user can load such small media without removal of paper in the input media tray, which is required by many prior art devices.

Given the foregoing, it will be appreciated that an apparatus is needed which allows center feeding of small media and does not require removal of media in an input tray to feed. It is further appreciated that a device is needed which automatically centers the small media for proper feeding and edge-to-edge printing.

SUMMARY OF THE INVENTION

A small or special media guide-in tray comprises a media tray, an aperture disposed in the media tray, and first and second opposed guide arms extending through the aperture and biased to a first position with the first and second opposed guide arms being synchronously engaged. The first and second opposed guide arms are pivotally attached to the media tray and each comprise a radiused edge having a plurality of gear teeth allowing for synchronized movement of the guide arms. The gears are centrally aligned with a media being fed through said small media guide-in device. The device further comprises on each of the first and second opposed guide arms having opposed eyelets for receiving a biasing component therebetween. The biasing component extends between the opposed eyelets and biases the guide arms to a first position. The first and second opposed guide arms are pivotable between the first innermost position and a second more opened position for receiving a plurality of media sizes. The guide arms pivot an equal distance at an equal rate due to their synchronous connection. The first and second opposed guide arms each having an angled web portion for receiving small media. The angled web portions of the guide arms engage the small media and create resultant component forces which spread open the guide arms. The aperture and the guide arms define a downwardly directed feed path through said media tray. The guide-in tray may be utilized with an L-path media feed wherein the media tray is an input tray or a C-path media feed wherein the media tray is an exit tray.

DETAILED DESCRIPTION

Referring now in detail to the drawings, wherein like numerals indicate like elements throughout the several views, there are shown in FIGS. 1-9 various aspects of a small media guide-in device. The device allows media of a preselected size to be fed into a peripheral device for printing and automatically centers the media for center fed media feed systems. The device further allows feeding of small or specialty media into the peripheral device without removal of the primary media disposed in an input tray of the peripheral device. Although the media guide-in tray is generally shown and described herein for use with a C-path media feed device, it is well within the scope of the present invention that the media guide-in tray be utilized with an L-path feed device for instance where the media tray defines an input tray.

Figure 1:
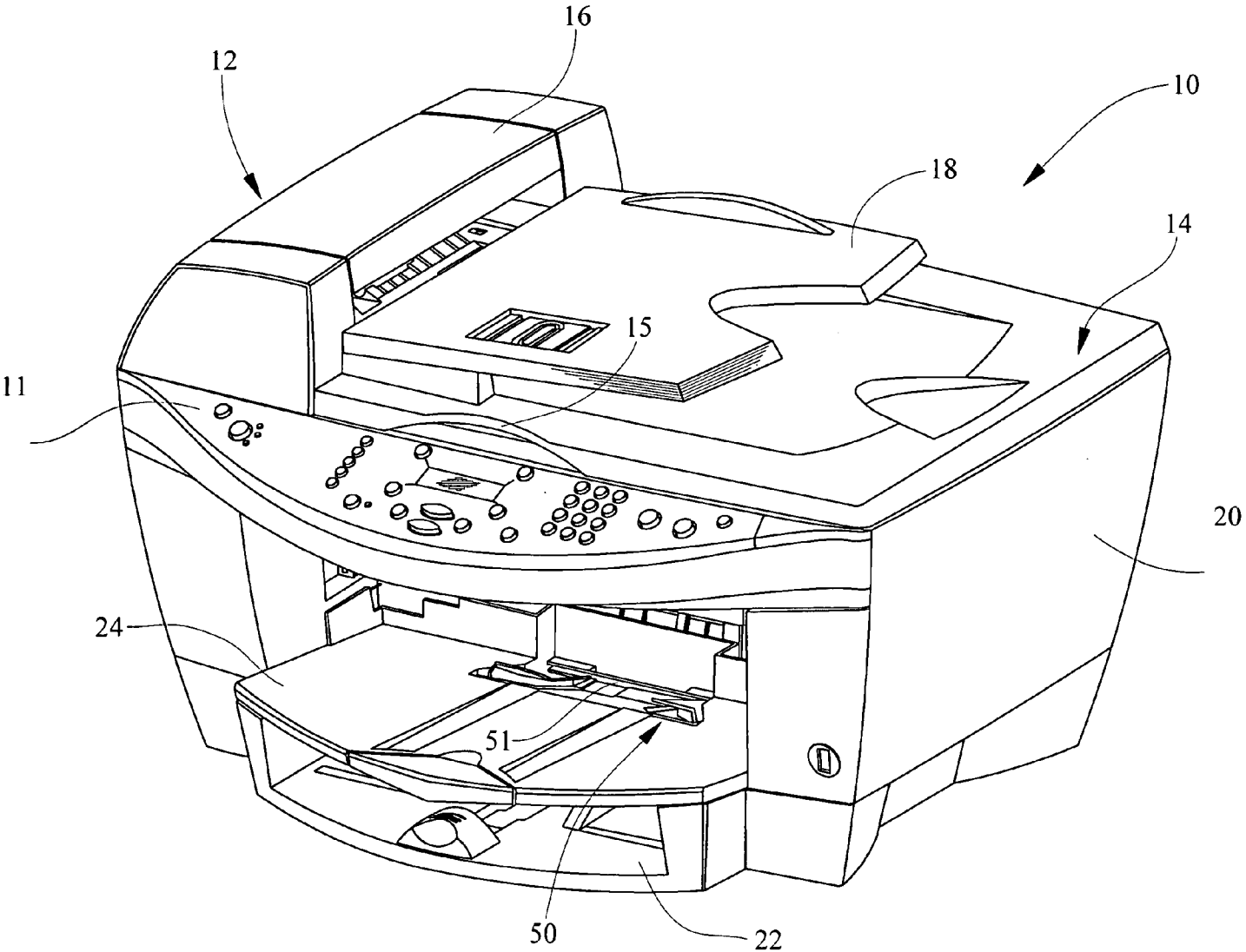
FIG. 1 is a perspective view of an illustrative image forming apparatus including a media feed system.

Referring initially to FIG. 1, a multi-function peripheral device 10 is shown having a scanner portion 12 and a printer portion 20. The multi-function peripheral device 10 is shown and described herein for purpose of clarity, however one of ordinary skill in the art will understand, upon reading of the instant specification, that the present invention may be utilized with a stand alone printer, or other devices utilizing media feed systems for small media sizes. The peripheral device 10 further comprises a control panel 11 having a plurality of buttons for making selections. The control panel 11 also includes a graphics display to provide a user with menus, choices or errors occurring with the system.

Referring still to FIG. 1, the scanner portion 12 generally includes a lid 14 which is pivotally connected to the peripheral housing along an upper rear edge of the peripheral housing. Beneath the lid 14 may be a transparent platen for placement and support of target documents for manually scanning. Along a front edge of the lid is a handle 15 for opening of the lid 14 and placement of the target document on the transparent platen (not shown). Adjacent the lid 14 is an auto-document feeder 16 which automatically feeds and scans stacks of documents which are normally sized, e.g. letter or A4, and suited for automatic feeding. Above the lid 14 and adjacent an opening in the auto-document feeder is an auto-document feeder input tray 18 which supports the target documents to be fed to the auto-document feeder 16. Beneath the input tray 18, the lid 14 also functions as an output tray for receiving documents fed through, and scanned by, the auto-document feeder 16.

Within the scanning portion 12 is an optical scanning unit having a plurality of parts which are not shown but generally described herein. The scanning unit may comprise a scanning motor and drive which connects the scanning motor and a scan bar. The scan bar is driven bi-directionally along a scanning axis defined as the direction of the longer dimension of the lid 14 and a scanner bed there beneath. At least one guide bar may be disposed within the scanner bed and may extend in the direction of the scanning axis to guide the scanning unit along the scanning axis. The scan bar moves along the at least one guide bar within the scanner bed beneath the platen. The scan bar may include a lamp, an image sensor, and a mirror therein for obtaining a scanned image from a document. The image sensor may be an optical reduction type image sensor or a contact image senor (CIS). The optical reduction type image sensor may include an array mounted on a circuit board and may be formed of a collection of tiny light-sensitive diodes which convert photons into electrons. These diodes, also called photosites, operate such that the brighter the light that hits a single photosite, the greater the electrical charge that will accumulate at that site. The target image may be scanned using a light source, such as a fluorescent bulb, and may reach the array through a series of mirrors, filters and lenses. Generally, an optical reduction type sensor builds an electrical charge in response to exposure to light. The amount of charge buildup is dependent on the intensity and duration of the exposure to the light. Such optical reduction image sensor cells are typically aligned in a linear array so that each cell has a portion of a target image impinged thereon as the array moves relative to the target document or the document moves relative to the array.

Differentiating from optical reduction devices, a contact image sensor (CIS) may alternatively be utilized to perform the scanning function of a target document. The CIS may include an array of light sources, such as light emitting diodes (LEDs) and array of photosensors adjacent the LEDs for converting the light to electrical signals for processing of the image generated. The LEDs are generally placed very close to a glass plate upon which a target media may be positioned. The LEDs may include red, green, and blue emitting diodes which combine to produce a white light source which is captured by the row of sensors. Color scanning may be performed by illuminating each color type of LED separately and then combining the three scans. An advantage of the CIS is that it is less susceptible to having foreign particles such as dust settle on the optics system which can degrade the scanned image quality. Further, the CIS has fewer reflecting optics than the CCD scanner device and therefore has a smaller size due to its optical configuration.

In either event, the image sensor then determines the image and sends data representing the image to onboard memory, a network drive, or a PC or server housing, a hard disk drive or an optical disk drive such as a CD-R, CD-RW, or DVD-R/RW. Alternatively, the original document may be scanned by the optical scanning component and a copy printed from the printer portion 20 in the case of a multi-function peripheral device.

Still referring to FIG. 1, the printer portion 20 comprises a media input tray 22 and a media exit tray 24 disposed above the input tray. As previously described, this is commonly referred to as a C-path feed device and is aesthetically pleasing because the input media is partially surrounded and hidden from view. Both the input tray 22 and the exit tray 24 extend from the printer portion housing. The exit tray 24 further comprises a small media guide-in tray 50 having a guide-in tray aperture or slot 51 located at the rear portion of the exit tray 24.

Figure 2:
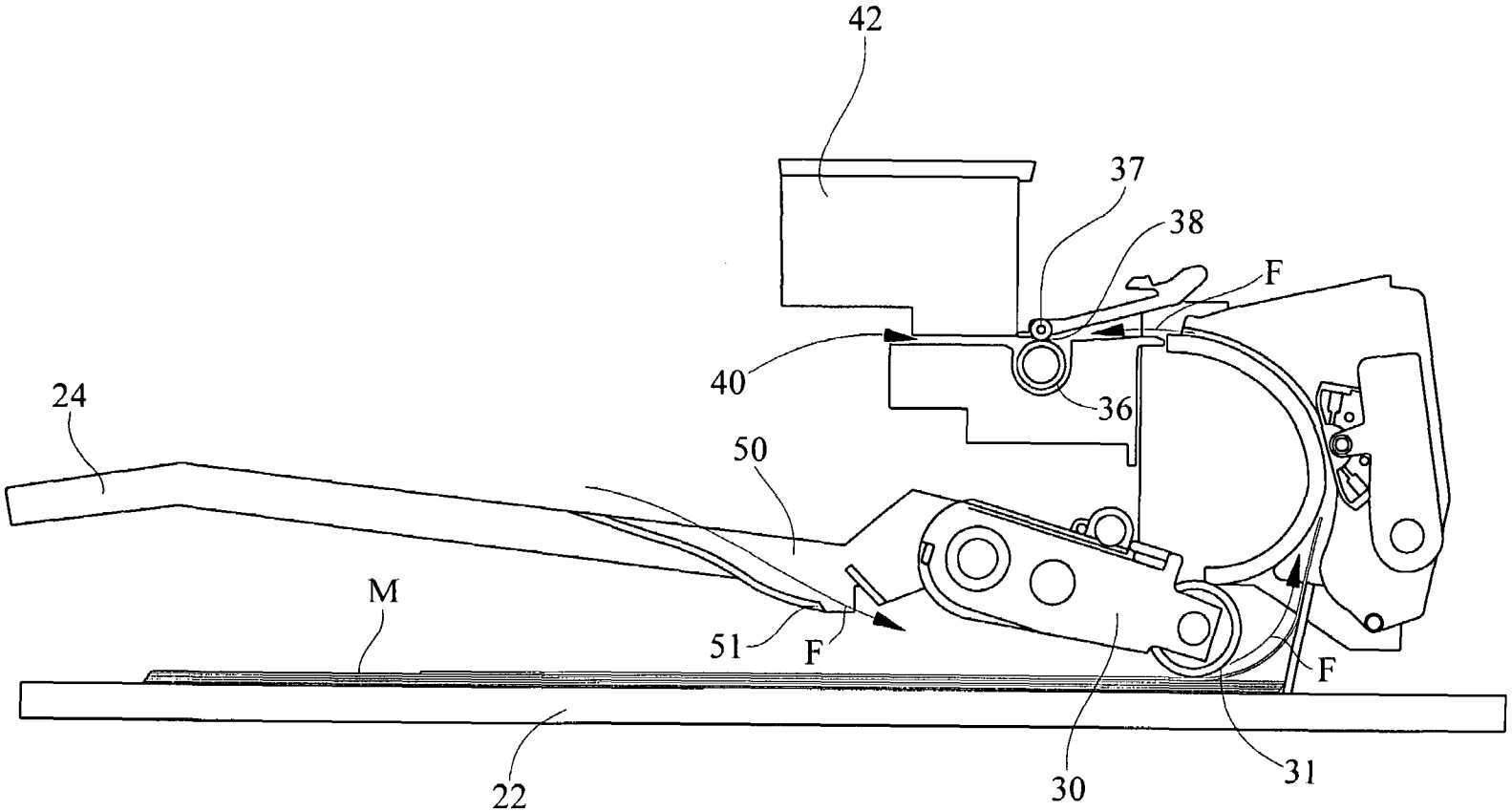
FIG. 2 is a side view of the C-path media feed of the image forming apparatus of FIG. 1.

Referring now to FIG. 2, a side view of the printer portion 20 is depicted revealing the C-path paper feed of the peripheral device 10 (FIG. 1). A plurality of media M is disposed on the input tray 22 at a lower portion of the feed mechanism. Generally, the media M is picked by a paper picking mechanism, such as auto-compensating mechanism 30, and directed upwardly by a pick tire 31 located on the auto-compensating mechanism 30. The media is fed upwardly through the feed path F between an inner media guide and an outer media guide until the media reaches a feed nip 38 defined by a feed roller 36 and a feed idler 37. As the media is fed by the feed roller 36 to a print zone 40, a print cartridge 42 is signaled by a print controller to selectively eject ink droplets onto the media passing therebelow. The print cartridge 42 translates along a path substantially transverse to the feed path F, for example, through a plane extending into and out of the page. As the media passes beneath the cartridge 42, the ink droplets are ejected by heat or pressure pulses onto the media producing a desired image. As the media advances through the print zone 40, the media exits the feed path F and is released onto the exit tray 24.

Still referring to FIG. 2, the small media guide-in tray or device 50 is shown including an aperture or slot 51 extending through the exit tray 24 and down to the input tray 22. Media guide arms 52 and other portions of the media guide-in device 50 are not shown in FIG. 2 for purpose of clarity. The slot or aperture 51 provides a path for small or specialty media to be fed through the exit tray into the feed path F for picking by the auto-compensating mechanism 30. It should be clear to one of ordinary skill in the art that various media of preselected sizes may be utilized with the present invention and this description merely describes the use of small media since such media is typically used for envelopes, photos and the like of specialty print processing. Although the term small media is utilized throughout this description, it should be understood that this device is not limited to such media. The exit tray 24 is sized for a first media which is larger in its nominal width dimensions, than the small media used in the guide-in device 50.

Figure 3:
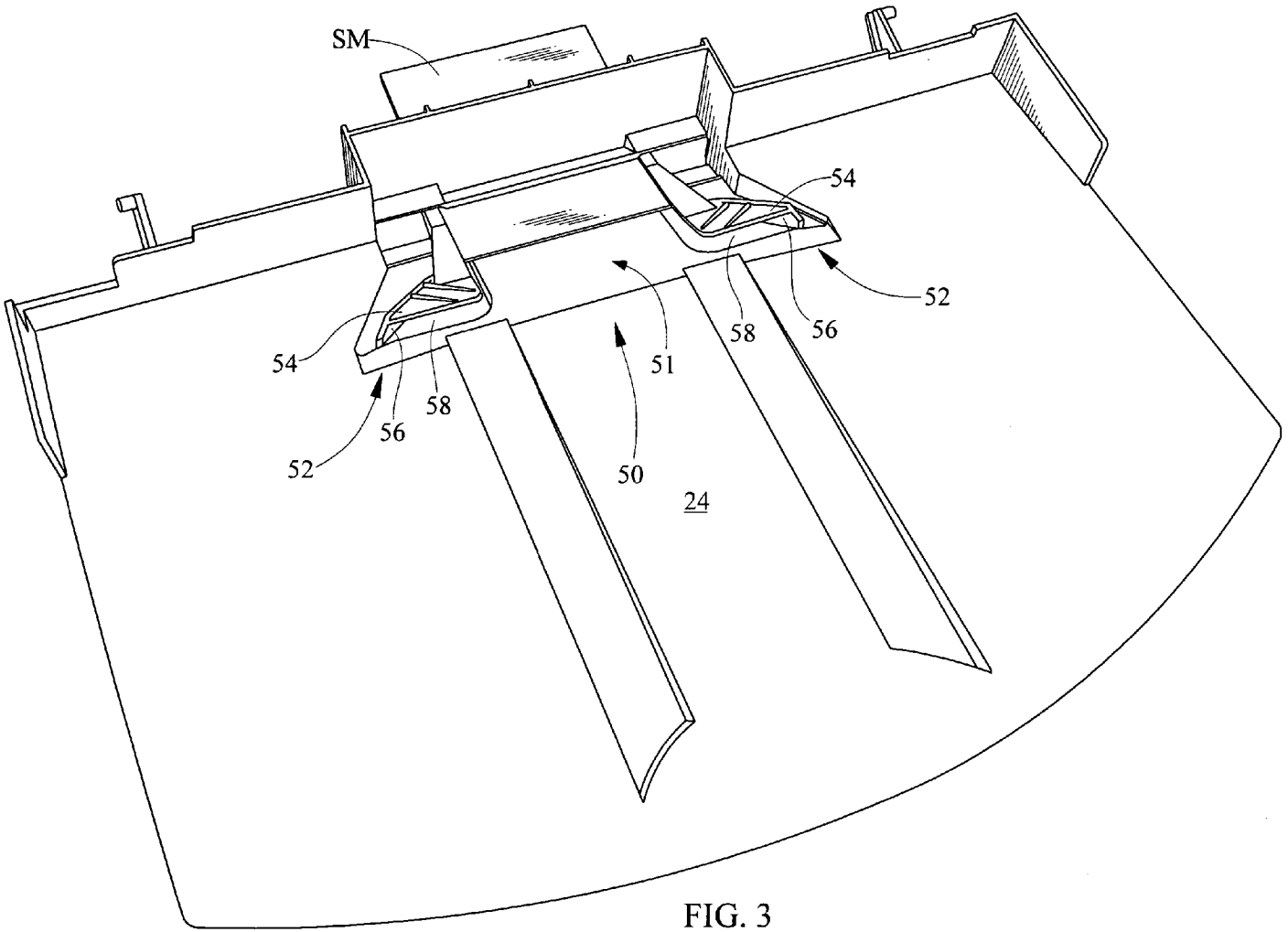
FIG. 3 is a front perspective view of the exit tray and small media guide of the image forming apparatus of FIG. 1.

Referring now to FIGS. 2 and 3, a perspective view of the exit tray 24 is shown depicting the small media guide-in device 50 and small media guide-in aperture 51. The small media guide-in device 50 comprises a downwardly directed path which directs the small media SM from a position on the exit tray 24 into the feed path F. The small media guide-in device 50 further comprises left and right media guide arms 52 which receive and automatically center the small media SM, and which further direct the small media SM through the guide-in aperture 51. The media guide arms 52 extend through the guide-in aperture 51 and can rotate within the aperture through a preselected angular distance to receive and center small media of varying sizes. The media guide arms are pivotally connected to the lower surface of the exit tray 24 as later described.

Figure 4:
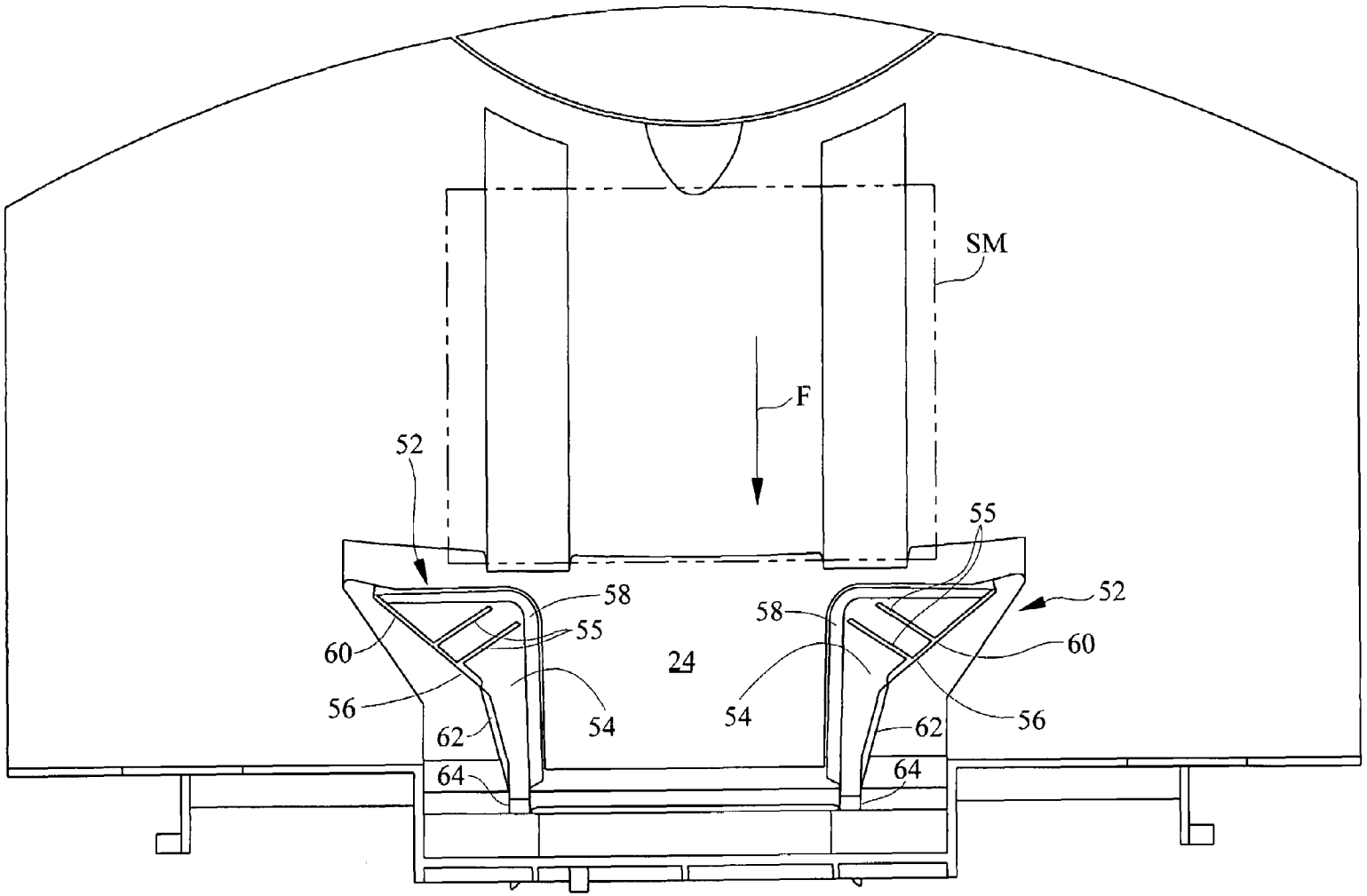
FIG. 4 is a top view of the small media guide with media positioned in front of and not yet inserted into the arms of the media guide.

Referring now to FIGS. 3 and 4, the media guide arms 52 are substantially U-shaped or C-shaped channels having an upper flange 54, a lower flange 58 and a web 56 extending between the upper flange 54 and the lower flange 58. The channel shape of the media guide arm 52 receives and guides the small media SM through the guide-in aperture 51 and thus provides an upper, a lower and an interposed guide surface for directing the small media SM toward the auto-compensating mechanism 30 (FIG. 2) and along the feed path F (FIG. 2). As illustrated, the web portions 56 are dimensioned such that a stack of approximately five sheets of small media can be accommodated in the web portions 56. Again the precise dimensioning of the web portions 56 is a matter of design choice to one of skill in the art. The upper flange 54 and lower flange 58 are substantially triangular in shape as best seen in FIG. 4 but may be defined by a plurality of shapes. The upper flange 54 is positioned slightly above the upper surface of the exit tray 24 and lower flange 58 is positioned slightly below the exit tray 24 in order to inhibit misfeeds and direct media through the guide-in aperture 51. As further depicted in FIG. 4, the upper flange 54 is cantilevered from the web 56. In order to provide better support for the cantilevered upper flange 54, ribs 55 extend from the web 56 and are formed integral with both the web 56 and the upper flange 54 in order to provide a rigid support for the upper flange 54.

Referring still to FIGS. 3 and 4, the webs 56 of the media guide arms 52 comprise three walls. Each outermost web wall 60 angles outwardly from the center line of the guide-in device 50 and engages the largest pieces of media accepted by the small media guide-in device 50. A central web wall 62 is disposed at an angle which is less than the angle that the outermost web wall 60 is disposed at with respect to the media edges and is engaged by small media which is too small to engage the outermost web wall 60 but is larger than the spacing provided at the innermost position of innermost web wall 64. The media guide arms 52 also comprise an innermost web wall 64 which is substantially parallel to the feed direction through the small media guide-in tray 50. The distance between these two opposed innermost walls 64 represents that smallest width of small media that can be reliably guided and positioned by the media guide-in tray 50. In the feed direction, the engagement by a small media sheet with the angled orientation of the web walls 60 and 62 provides an outwardly directed force component on the guide arms 52. Thus, as shown in comparison to FIGS. 5 and 6, the media guide arms 52 rotate outwardly as the walls 60, 62 are engaged by media being fed through media guide-in device 50 allowing receipt of various media types within a preselected size range.

Referring still to FIG. 4, a single sheet of small media SM is shown in broken line advancing toward the small media guide arms 52 in a feed direction F. The small media SM can represent various types of media including, but not limited to, envelopes, 3"×5" index cards, Hagaki, 4"×6" photo sheets, and the like wherein the leading edge of the media may range from about 2.5" to about 4.75" or greater, although these dimensions may vary according to design preferences. As used herein small media means any media having a width that can be accommodated by the aperture and guide arms that is provided in the media tray. The sizing of such aperture and guide arms is a matter of design choice to one of skill in the art. As shown in FIG. 4, the small media SM is moving toward, but not yet engaging, the guide arms 52. As the small media moves toward the guide arms 52, the small media SM enters the channel shaped guide arm 52 between the upper flange 54 and the lower flange 58. The guide arms 52 are biased to an innermost first position which is the most closed position of the guide arms 52.

Figure 5:
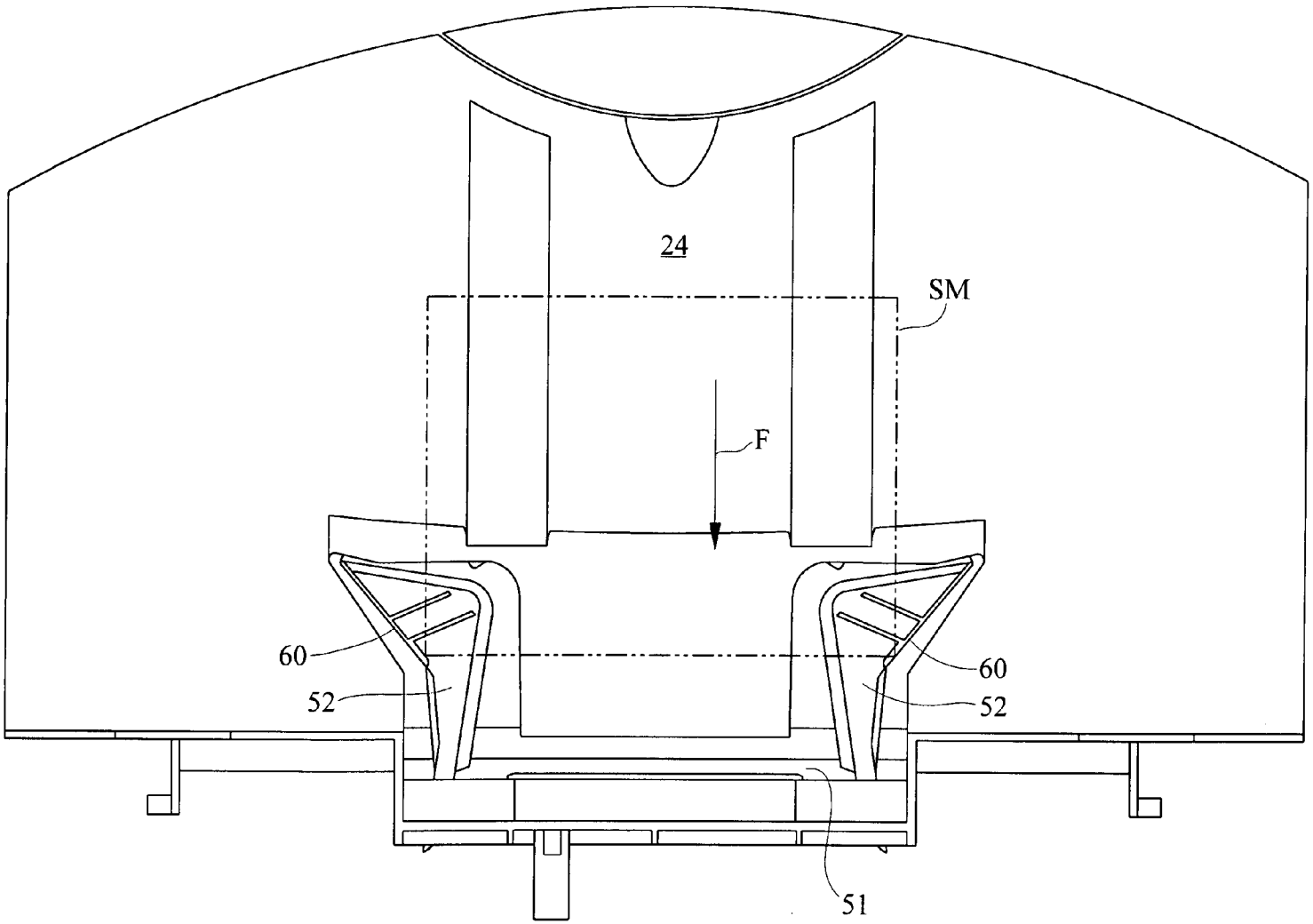
FIG. 5 is a top view of the small media guide assembly with media initially engaging the arms of the guide.

Referring now to FIG. 5, the small media SM is advanced by the user from its position in FIG. 4 so that the leading edge of the small media SM is engaging the outermost walls 60 of the media guide arms 52. The engagement of the small media SM synchronously rotates the media guide arms 52 outwardly an equivalent distance at an equivalent speed to accept the small media SM as it advances in the feed direction of the feed path F. Further, due to the angled design of the walls 60 and 62, the small media SM is centered as it is positioned within the media guide arms 52.

Figure 6:
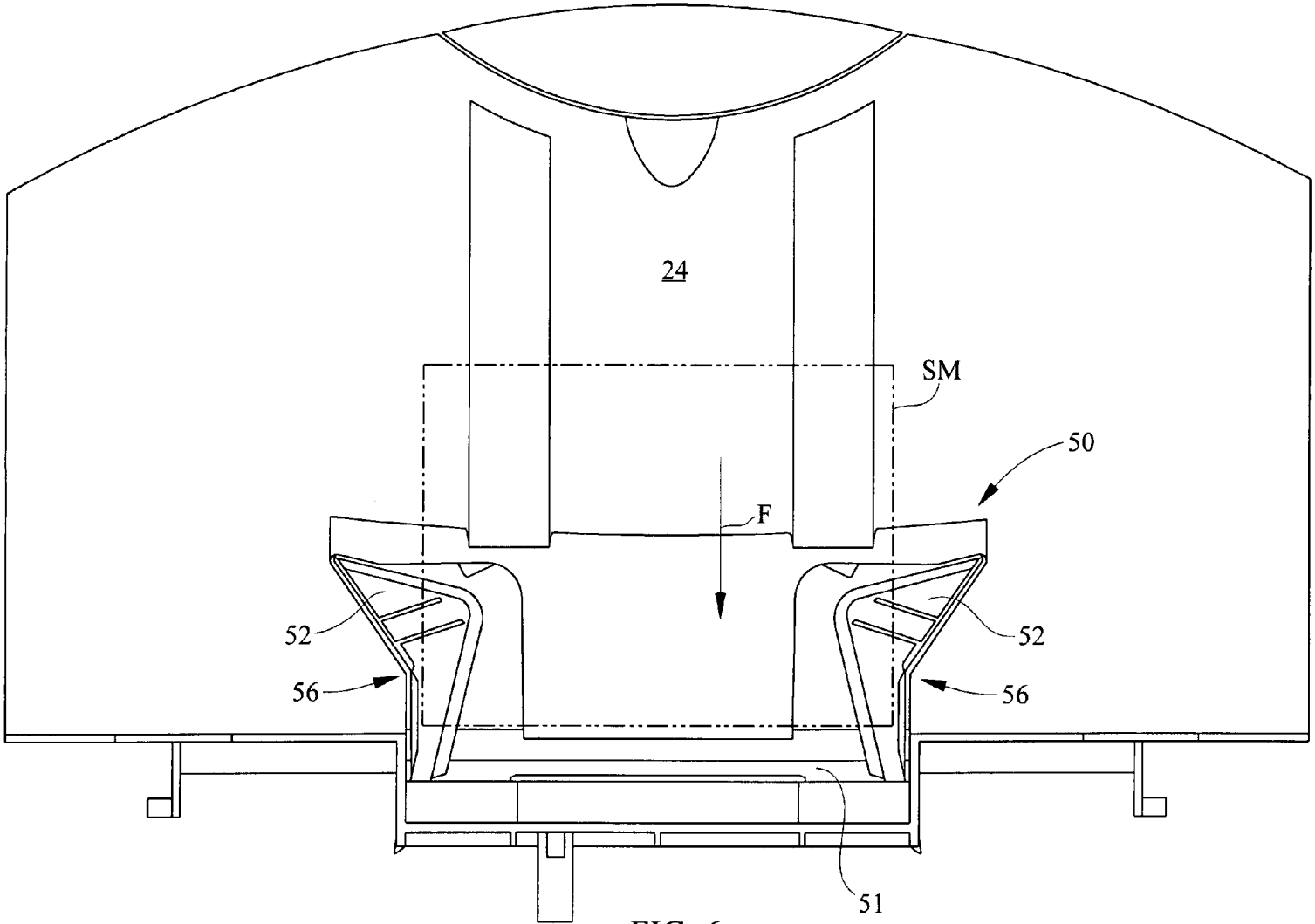
FIG. 6 is a top view of the small media guide arms in a second position with the media fully inserted into the guide.

According to FIG. 6, the small media SM is advanced to an outermost position further along the feed path F than the position previously shown in FIG. 5 and is shown in a fully opened position for directing a maximum pre-selected size media through the media guide-in device 50. The media guide arms 52 can rotate from the first or innermost position shown in FIG. 4 to the outer most position shown in FIG. 6 to accept small media of varying sizes within a pre-selected range for feeding through the media guide-in device 50. For example, larger pieces of media may cause the media guide arms 52 to rotate outwardly to a position shown in FIG. 6 whereas smaller media sizes may only cause the media guide arms 52 to rotate outwardly to a position shown in FIG. 5. Regardless of the media size utilized with the present invention, the media guide arms 52 rotate synchronously so that each guide arm 52 rotates an equal distance as the opposite guide arm 52 according to the size of the input media. Thus, the small media SM remains centered the media during passage between the upper flange 54 and the lower flange 58 of the media guide arms 52.

As previously indicated, the present device is utilized with a center feed system which picks the media from the input tray 22. The media guide arms 52 automatically center the media for proper feeding by the center feed media feed system, which requires central alignment of the media being fed.

Figure 7:
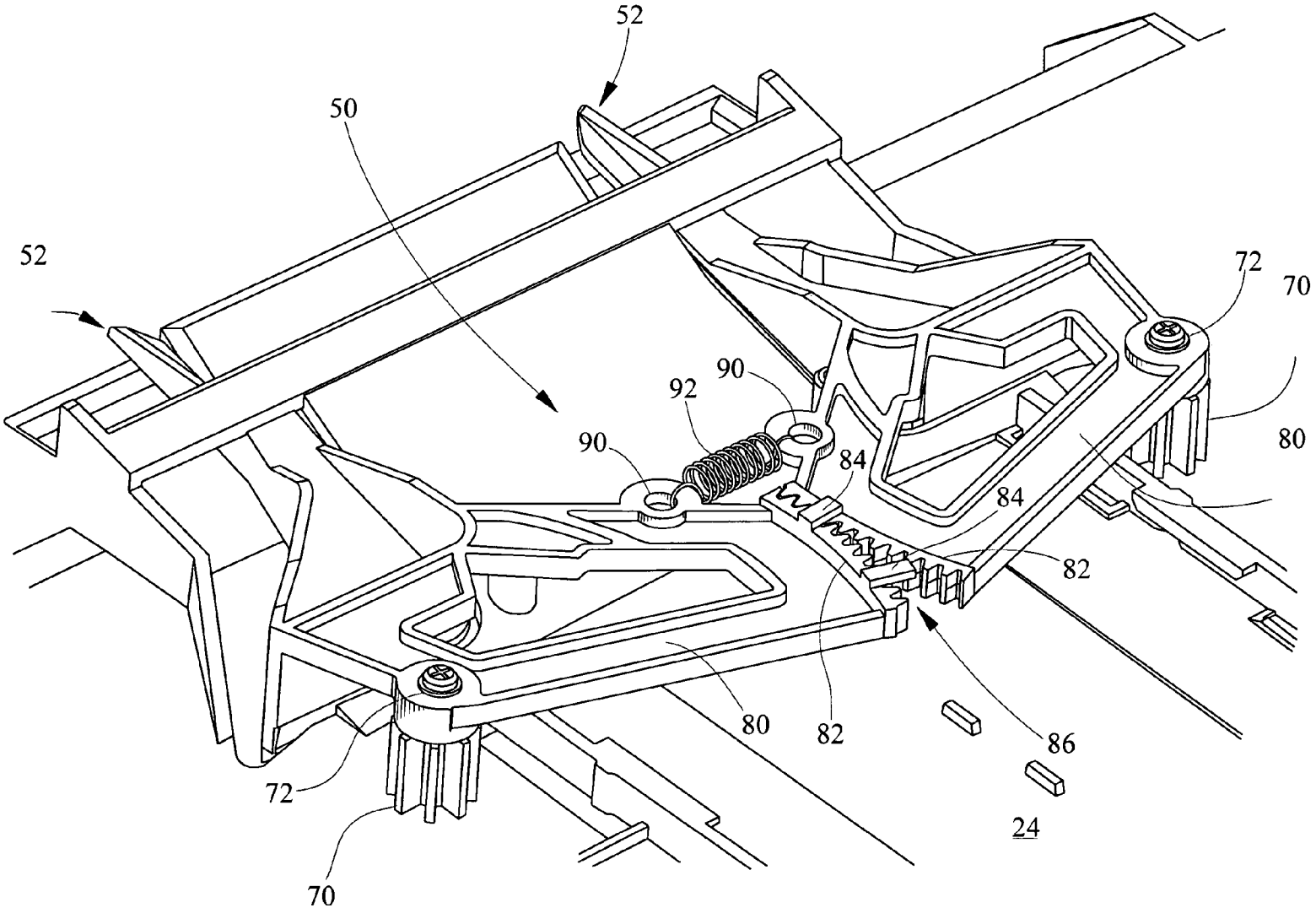
FIG. 7 is a bottom perspective view of the small media guide assembly shown in the position illustrated in FIG. 4.

Referring now to FIG. 7, a bottom perspective view of the small media guide 50 illustrates the structure utilized to synchronously rotate the media guide arms 52 and automatically center the small media being fed through the media guide arms 52. Extending from the lower surface of the exit tray 24 are opposed posts 70 symmetrically spaced about the center of the exit tray 24 and which provide for pivotal movement of the media guide arms 52. In the illustrative configuration, the posts 70 are symmetrically disposed about a central axis of the media feed direction. As further depicted in FIG. 7, the guide arms 52 may be connected to the posts 70 by a fastener 72 which extends through the media guide arm 52 and into the posts 70. The fastener 72 may be a screw, bolt, rivet, or other such fastening device providing a pivotal connection. More specifically, the media guide arms 52 extend from opposed bodies 80, which are pivotally connected to the posts 70.

The opposed bodies 80 engage one another along a central axis of the exit tray 24 to provide synchronous movement of the guide arms 52. Each of the opposed bodies 80 extend from the post 70 to which the bodies 80 are pivotally connected. The opposed bodies 80 are generally pentagonal in shape including an innermost radiused edge 82. It should be clear to one of ordinary skill in the art upon reading of this disclosure that the bodies 80 may be defined by a plurality of geometric shapes and/or structures such that the bodies 80 engage one another at a central location relative to the aperture 51. Along the radiused edge 82, the opposed bodies 80 engage one another as described hereinafter for synchronous movement of the guide arms 52. As a result, the guide arms 52 rotate equal distances at equal speeds. The radiused edges 82 each include a plurality of gear teeth 86 which engage opposed gears 86 of the opposed body 80 during movement of the media guide arms 52 from a first position (FIG. 4) through a range of motion (FIG. 5) to a second outermost position (FIG. 6) and back to the first position. The gear teeth 86 provide the synchronous motion of guide arms 52 so that rotation of one arm 52 causes an equidistant rotation in the opposed guide arm 52 at an equal speed. Accordingly, when a small media sheet is fed in a skewed manner and engages one of the guide arms 52, both guide arms 52 will open an equal distance and speed and the angled web 56 will direct the small media to a central position, relative to the opposed guide arms 52, for proper feeding and automatic centering of the small media being fed.

Extending from an upper surface of the radiused edge 82 may be ribs 84 which extend over the opposed radiused edge 82 of the opposed body 80. The ribs 84 of one edge 82 slide relative to the opposed body 80 so that the gear teeth 86 remain in the same plane and do not become unengaged. As shown, the ribs 84 inhibit the opposed bodies from moving out of alignment. Alternatively, at least one rib may be positioned extending from a lower surface of the radiused edge 82 to inhibit the opposed body 80 from moving downwardly out of engagement therewith. The ribs 84 maintain the bodies 80 in a generally planer relationship to one another so that the gear teeth 86 do not disengage.

According to the present embodiment, the gear teeth 86 are centrally aligned with the center of the small media SM passing on the upper surface of the exit tray 24 or with the centerline of the aperture 51. When the gears 86 are centrally aligned, the radiused edges 82 have equivalent radii as measured from the posts 70. With equal radii and equivalent gear tooth sizes the media arms 52 are directed to move an equal amount relative to one another. The arc length of the radiused edges 82 may vary dependent upon the size (width) of media to be utilized with the small media guide 50 and the range of motion desired for the guide arms 52.

Also located on the bodies 80 are eyelets 90. Extending between the opposed eyelets is a biasing member, such as coil spring 92, which places a bias force on the bodies 80 and consequently the media guide arms 52. The coil spring 92 maintains a bias on the bodies 80 and media guide arms 52 to position the media guide arms 52 at their first or an innermost position, as shown in FIGS. 4 and 7, in order that the guide arms 52 center the small media being fed therethrough. The spring 92 is tensioned such that the bias is not strong enough to buckle the small media SM but is strong enough to center the small media passing between the guide arms 52. In order to center the small media, the biasing force must be sufficient overcome friction of the guide arms 52 as well as friction of the media on the upper surface of the tray 24.

Figure 8:
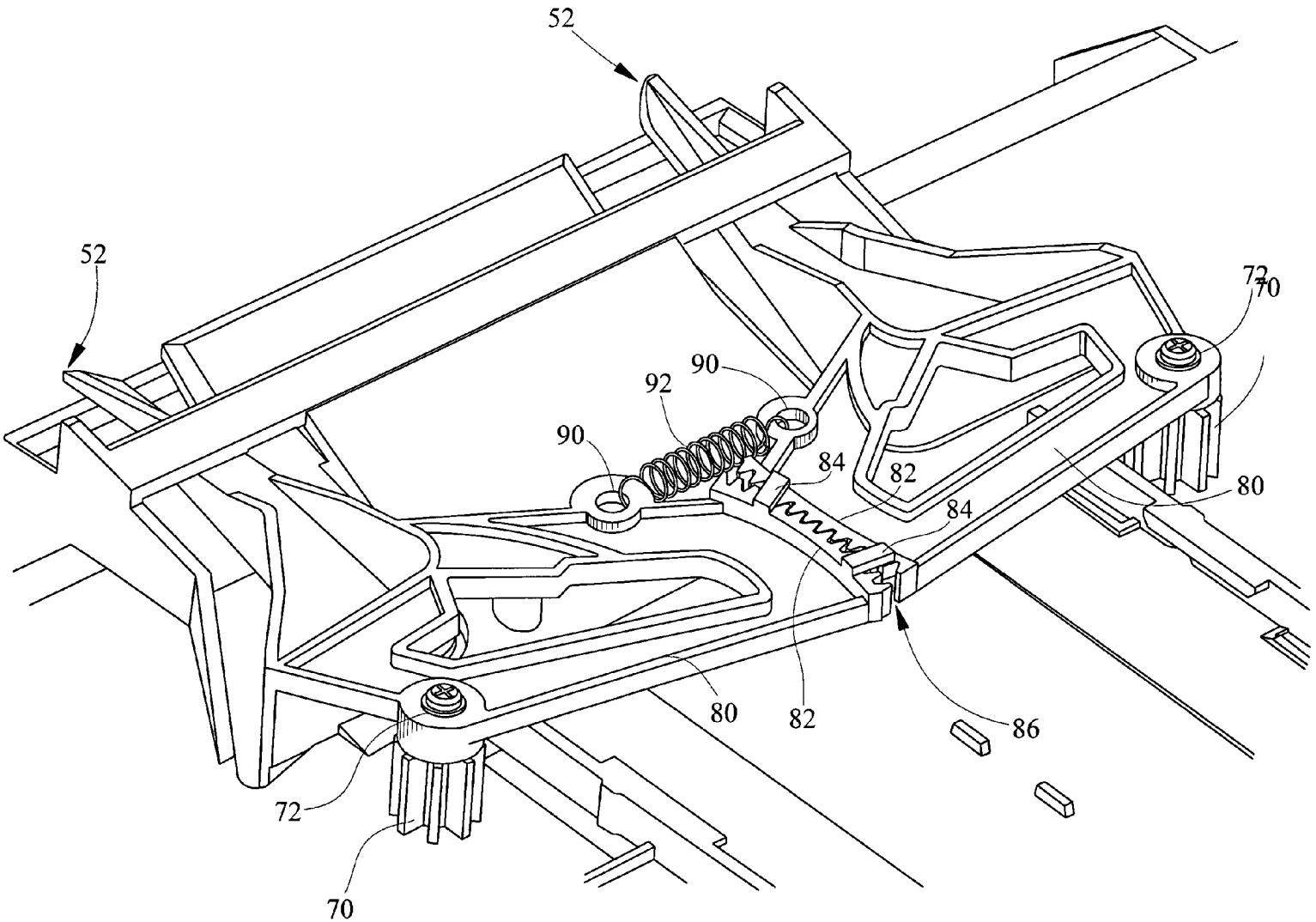
FIG. 8 is a bottom perspective view of the small media guide assembly shown in the position illustrated in FIG. 5.

Referring now to FIG. 8, the media guide arms 52 are moved to an intermediate position corresponding to the position shown in FIG. 5. As seen in FIG. 8, the coil spring 92 extending between the eyelets 90 is stretched from its position in FIG. 7 so that the media guide arms 52 are outwardly extended through the pre-selected range of motion and so that the gear teeth 86 are meshed in a position distinguishable from FIG. 7.

Figure 9:
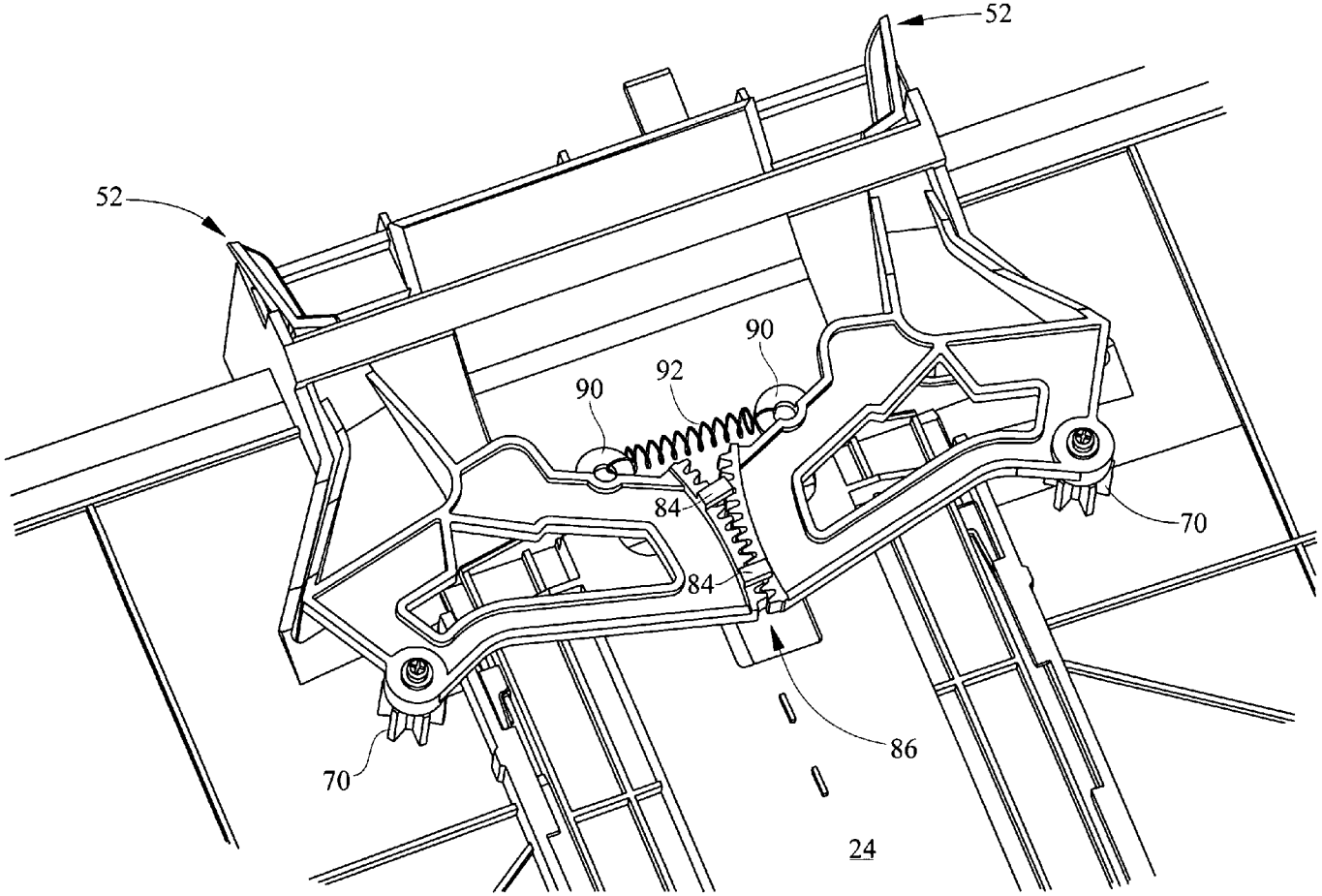
FIG. 9 is a bottom perspective view of the small media guide assembly positioned at its largest opening.

As depicted in FIG. 9, the media guide arms 52 are rotated to an outermost position so that the media guide-in device 50 can receive the largest size of small media desired to be utilized therewith. As seen the figure, the coil spring 92 is further elongated and the gear teeth 86 are meshed at a position differentiated from that of FIGS. 7 and 8.

In operation, small media SM is loaded onto the exit tray 24 and manually directed toward the guide arms 52. As the leading edge of the small media SM engages the guide arms 52, and more specifically the angled web 56, the force on the small media SM and the angled design of the web 56 causes an outwardly directed force component on the guide arms 52 which overcomes the bias force of spring 92. As a result the guide arms 52 begin moving outwardly and the angled web design 56 directs the small media SM to a central position between guide arms 52. If the small media SM is skewed and engages only one of the guide arms 52, due to the structure of the present invention both arms 52 move outwardly and the small media SM is centered between the two arms 52 by the angled webs 56. Once the full width of the small media SM is received by guide arms 52, the guide arms 52 stop their outward rotation and stay in that position until the small media SM has passed through the media guide-in aperture 51. As the small media SM passes through the guide-in aperture 51 and clears the guide arms 52, the spring bias returns the guide arms 52 back to the first or innermost position. From this position the small media guide-in device 50 is ready for a subsequent media sheet.

The foregoing description of several embodiments of the invention have been presented for purposes of illustration. It is not intended to be exhaustive or to limit the invention to the precise forms disclosed, and obviously many modifications and variations are possible in light of the above teaching. It is intended that the scope of the invention be defined by the following claims.

What is claimed is:

1. A small media guide-in tray for a media handling device, comprising:

a media tray sized for holding a first media, said media tray having an aperture therethrough;

first and second opposed guide arms pivotally connected to said media tray for receiving therebetween a second media within a predetermined size range that is less than said first media, said first opposed guide arm synchronously engaging said and second opposed guide arms being synchronously engaged; and, a biasing member connected to said guide arms for biasing said arms to a first position, said guide arms moveable to a second position as said second media is inserted therebetween, said guide arms and said biasing member centering said received second media for passing through said aperture;

wherein said first and second opposed guide arms each further comprise a radiused edge having a plurality of gear teeth for intermeshing with the other opposed guide arm as said guide arms rotate.

2. The small media guide-in tray of claim 1 further comprising said media tray being an exit tray.

3. The small media guide-in tray of claim 2 further comprising said media tray being disposed above an input tray in a C-path media feed system.

4. The small media guide-in tray of claim 1 further comprising said first and second opposed guide arms extending through said aperture.

5. The small media guide-in tray of claim 1 further comprising said gear teeth being centrally aligned with said second media being fed through said small media guide-in tray.

6. The small media guide-in tray of claim 1 further comprising said plurality of gear teeth being centrally aligned with said media tray.

7. The small media guide-in tray of claim 1 further comprising each of said first and second opposed guide arms having an opposed eyelet for receiving a respective end of said biasing member.

8. The small media guide-in tray of claim 1 further comprising said guide arms pivoting an equal distance at an equal rate as media is inserted therein.

9. The small media guide-in tray of claim 1 further comprising said first and second opposed guide arms being substantially C-shaped in cross section with each guide arm having an angled web portion for receiving said second media.

10. The small media guide-in tray of claim 9 further comprising said angled web portions of said guide arms when engaging a small media create resultant component forces which rotatably spread said guide arms.

11. The small media guide-in tray of claim 1 further comprising said aperture and said guide arms defining a downwardly directed feed path through said media tray.

12. The small media guide-in tray of claim 1 wherein said media handling device further comprises a paper picking mechanism and said aperture and said guide arms centrally aligning said second media with said paper picking mechanism.

13. The small media guide-in tray of claim 12 further comprising said aperture and said guide arms defining a downwardly directed feed path through said media tray for feeding said second media to said paper picking mechanism.

14. A small media guide-in device for an media handling device, comprising:

a media tray having an aperture therethrough for small media and opposed pivotally mounted bodies;

each of said opposed bodies having a plurality of gear teeth extending from a radiused edge of said body;

opposed guide arms substantially C-shaped in section extending from said bodies, synchronously engaged to move with said plurality of gear teeth through said aperture when a sheet of said small media is inserted therebetween and biased toward a first position and and extending through said aperture in said media tray;

a biasing spring connected between said bodies biasing said guide arms to said first position; and, a feedpath for said small media extending through said aperture in a direction defined by said opposed guide arms.

15. The small media guide-in device of claim 14 further comprising an outwardly angled web portion on each said opposed guide arms.

16. The small media guide-in device of claim 15 further comprising biasing spring connected between said opposed guide arms, said web portions and said springing centering a sheet of small media for feeding through said opposed guide arms and said aperture.

17. The small media guide-in device of claim 14 wherein said opposed guide arms are pivotable through a preselected radial distance.

18. The small media guide-in device of claim 14, said plurality of gear teeth on a first of said opposed guide arms and said plurality of gear teeth on a second of said opposed guide arm engaging one another for synchronous movement of said opposed guide arms.

19. The small media guide-in device of claim 14 further comprising at least two posts depending from a lower surface of said media tray and aligned with said aperture with said opposed bodies pivotally connected to said posts.

20. A small media guide-in tray for a media handling device containing a printing mechanism having a media input tray and a paper picking mechanism for feeding media to said printing mechanism, comprising:

a media exit tray having an aperture therethrough for feeding small media to said paper picking mechanism, said exit tray positioned above said input tray;

first and second opposed media guide arms extending through said aperture, said guide arms being substantially C-shaped in cross section with at least one edge being radiused and having a plurality of gear teeth, said guide arms and aperture defining a downwardly directed small media feed path through said media tray into said input tray and to said paper picking mechanism for feeding into said printing device;

at least two posts depending from a lower surface of said media tray and positioned adjacent said aperture with one of said guide arms pivotally connected to one of said post and the other of said guide arms pivotally connected to the other of said posts such that the gear teeth of said guide arms intermesh as the guide arms pivot in said aperture allowing for synchronous movement of said guide arms to a second position when said small media is inserted between said guide arms; and, a coil spring connected to and positioned between said first and second opposed media guide arms for biasing said arms in a first position in said aperture, said coil spring and said guide arms aligning said small media to be received by said paper picking mechanism.

21. The small media guide-in tray of claim 20 wherein one of said opposed guide has a rib thereon extending over and in slidable engagement with the surface of the radiused edge of the other of said guide arms for maintaining said opposed gear teeth in engagement.

* * * * *